US005131771A

United States Patent [19]

Kawahara

[11] Patent Number: 5,131,771

[45] Date of Patent: Jul. 21, 1992

[54] PRINTER EMPLOYING A CONTINUOUS PAPER OR A CUT PAPER SELECTIVELY AND BEING PROVIDED WITH A PAPER BAIL

[75] Inventor: Yuuji Kawahara, Nagoya, Japan

[73] Assignee: Brother Kogyo Kabushiki Kaisha, Nagoya, Japan

[21] Appl. No.: 736,921

[22] Filed: Jul. 29, 1991

[30] Foreign Application Priority Data

Oct. 31, 1990 [JP] Japan ..... 2-294581

[51] Int. Cl.[5] ..... B41J 11/50

[52] U.S. Cl. ..... 400/605; 400/616.2; 400/636.2; 400/639.1; 400/635

[58] Field of Search ..... 400/605, 611, 616, 616.1, 400/616.2, 624, 635, 636, 636.2, 639, 639.1

[56] References Cited

U.S. PATENT DOCUMENTS

| | | | |
|---|---|---|---|
| 3,625,333 | 12/1971 | Cortona et al. | 400/605 |
| 4,417,517 | 11/1983 | Matsuda et al. | 400/605 |
| 4,425,047 | 1/1984 | Narushima | 400/636 |
| 4,606,663 | 8/1986 | Cristoph et al. | 400/636 |
| 4,688,957 | 8/1987 | Prevignano | 400/625 |
| 4,702,632 | 10/1987 | Taketani | 400/639.1 |
| 4,859,098 | 8/1989 | Kawashima et al. | 400/605 |
| 4,896,979 | 1/1990 | Nolte et al. | 400/616.2 |
| 4,909,497 | 3/1990 | Mabashi et al. | 400/605 |
| 4,936,695 | 6/1990 | Ishii | 400/636.2 |
| 4,981,377 | 1/1991 | Hasegawa et al. | 400/605 |
| 4,995,745 | 2/1991 | Yokoi et al. | 400/616.2 |
| 5,062,722 | 11/1991 | Shizawa et al. | 400/621 |

FOREIGN PATENT DOCUMENTS

| | | | |
|---|---|---|---|
| 0131275 | 7/1985 | Japan | 400/605 |
| 0191176 | 11/1985 | Japan | 400/605 |
| 61-58775 | 3/1986 | Japan . | |
| 0246265 | 10/1988 | Japan | 400/605 |
| 2197737 | 5/1988 | United Kingdom | 400/605 |

*Primary Examiner*—Eugene H. Eickholt
*Attorney, Agent, or Firm*—Oliff & Berridge

[57] ABSTRACT

A printer comprises a platen roller for supporting and feeding a cut sheet, a first motor for rotating the platen roller and a tractor for feeding a continuous paper. The tractor is capable of being connected to the first motor through the platen roller. The printer comprises a second motor having first, second and third phases based on a rotational angle. A clutch can be connected to both the platen roller and the tractor and can be disconnected between the platen roller and the tractor based on driving force from the second motor. A paper bail roller is faced with the platen and the platen bail roller can be moved between a position contacting the platen and a position separated from the platen by paper bail roller moving unit based on driving force by the second motor. The first phase of the second motor corresponds to a position where the paper bail roller is separated from the platen, the second phase of the second motor corresponds to a position where the paper bail roller contacts the platen roller and that clutch connects the platen roller and the tractor, and the third phase of the second motor corresponds to a position where the paper bail roller contacts the platen roller and that clutch disconnects the platen roller from the tractor.

11 Claims, 9 Drawing Sheets

Ø7 736921

PRINTER EMPLOYING A CONTINUOUS PAPER OR A CUT PAPER SELECTIVELY AND BEING PROVIDED WITH A PAPER BAIL

BACKGROUND OF THE INVENTION

1. Field of the Invention

The present invention relates to a printer selectively employing a continuous paper or a cut paper and being provided with a paper bail roller and, more particularly, to a printer which is capable of selectively performing a print operation on a continuous paper or a cut paper using a single driving source, and is provided with a paper bail moved between a position contacting a platen and a position separated from the platen by the single driving source.

2. Description of Related Art

A conventional printer is capable of selectively feeding a print medium such as a continuous paper or a cut paper because the drive force of a paper feed step motor is always connected to the cut paper feeder and is either connected to or disconnected from a pin feed tractor for feeding continuous paper to thereby enable paper selection. In this type of printer, the paper feed step motor is directly connected to a platen by a timing belt or the like and pressure rollers for feeding the cut paper are disposed under the platen. The cut paper is inserted between the platen and the pressure rollers to be fed together with the rotation of the platen. The platen is provided with a platen gear for transmitting the drive force to the pin feed tractor.

The platen gear is meshed through a clutch gear with a pin feed tractor driving gear. The clutch gear is mounted on a clutch lever supported on a side frame and is movable between positions so as to be engaged with the pin feed tractor driving gear or disengaged from the pin feed tractor driving gear according to movement of the lever. Namely, in the above-mentioned continuous paper/cut paper changeover operation, the pin feed tractor is rotated according to the rotation of the platen when the clutch gear is engaged to feed the continuous paper. On the other hand, when the clutch gear is engaged, the continuous paper feed operation is not performed and the cut paper is fed between the platen and the pressure rollers by a cut sheet feeder or by a hand so that the cut paper feed operation is performed by the rotation of the platen.

Meanwhile, the paper bail roller is closed so that the print medium is fed on the platen. The paper bail roller is opened for inserting the print medium between the paper bail roller and the platen. The paper bail roller is rotatively mounted on a shaft extending between paper bail levers supported on the right and left side frames. In setting the print medium in the printer, the paper bail levers are moved to position the paper bail roller in front of the upper portion of the platen in an open state. The print medium is inserted between the platen and the paper bail roller and then the paper bail levers are moved in the opposite direction to place them in a closed state.

In this state, the print medium is fed by the pressing force and rotation of the paper bail roller together with the rotation of the platen.

It is desirable that the continuous paper/cut paper changeover operation and the paper bail roller opening/closing operation described above should be performed the minimum amount of time at the optimum timing. It is necessary to individually use a step motor, a plunger solenoid or the like as drive sources.

Although it is generally desirable for it to be manufactured at a low cost, provision of multiple drive sources has become a problem by making the printer a high cost item.

OBJECTS AND SUMMARY OF THE INVENTION

It is an object of the present invention to overcome the above described drawbacks and disadvantages, and to provide a printer which is capable of selectively performing a print operation on a continuous paper or a cut paper using a single driving source, and is provided with a paper bail capable of moving between a position contacting a platen and a position separated from the platen as driven by the single driving source.

It is another object of the present invention to provide a printer in which both the continuous paper/cut paper changeover operation and the paper bail roller opening/closing operation can be performed by a single drive source since the continuous paper/cut paper changeover operation must not be driven in synchronism with the paper bail opening/closing operation. Use of a single drive source results in lower manufacturing costs for the printer.

To achieve the above objects, there is provided a printer according to the invention, comprising:

a platen means for supporting a sheet;

a first driving means;

a first feeding means for feeding a continuous paper in cooperation with the platen means, the first feeding means being capable of being connected to the first driving means;

a second feeding means for feeding a cut sheet of paper in cooperation with the platen means, the second feeding means being connected to the first driving means;

a second driving means;

a clutch means for connecting between the first driving means and the first feeding means and for disconnecting the first driving means and the first feeding means based on a driving force exerted by the second driving means;

a paper bail means being faced to the platen means, the paper bail means being moved between a position contacting the platen means and a position separated from the platen means; and a paper bail moving means for moving the paper bail means between a position contacting the platen means and a position separated from the platen means based on the driving force exerted by the second driving means.

In a printer having the structure described above, the clutch means and the paper bail moving means are moved in accordance with the drive force exerted by second driving means as a single drive source.

When separating the paper bail means from the platen means, the drive force exerted by the second driving means is applied to the paper bail moving means to move the paper bail means between a position contacting the platen means and a position separated from the platen means.

In switching from the continuous paper print mode to the cut paper print mode, or from the cut paper print mode to the continuous paper print mode, using the continuous paper/cut paper changeover means, the drive force exerted by second driving means is applied to the clutch means so that the clutch means may engage the first driving means and the feeding means.

As is obvious from the above description, the separation of the paper bail roller from the platen and the changeover operation between continuous paper and cut paper can be performed by a second means such as a single drive source. As a result, a low cost can be effectively realized in comparison with conventional printers.

BRIEF DESCRIPTION OF THE DRAWINGS

The foregoing and other objects, features and advantages of the invention will become more apparent by reading the following detailed description of the presently preferred embodiments of the invention, when considered in connection with the accompanying drawings, in which.

DETAILED DESCRIPTION OF THE PREFERRED EMBODIMENT

The invention will be described in detail by using an example of the application to a printer with reference to the drawings.

Figure 1:
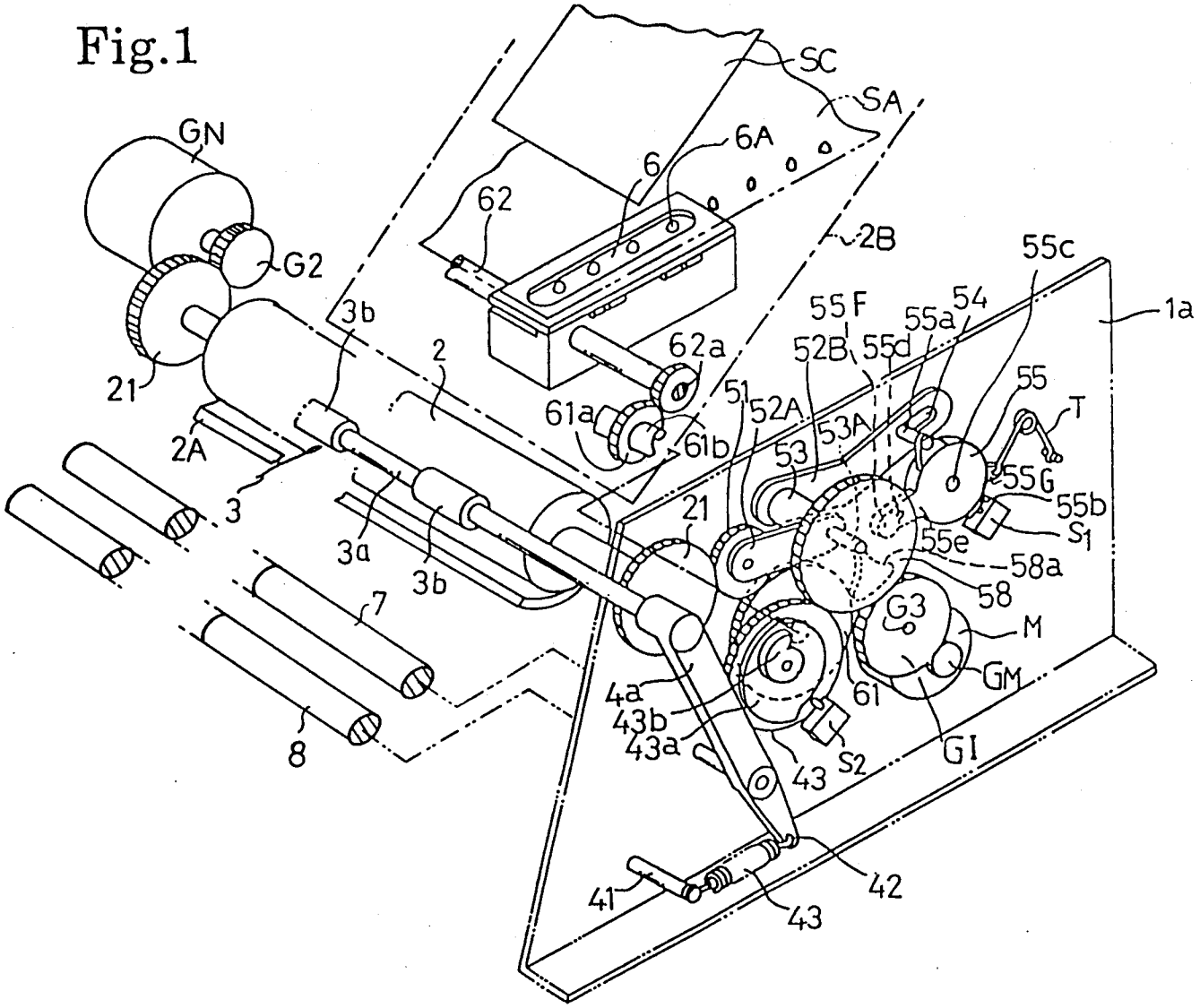
FIG. 1 is a perspective view of the mechanical structure of the printer of this embodiment.

FIG. 1 is a perspective view of the principal components of a printer in a preferred embodiment of the invention. In the printer, a platen 2 on which a print medium, such as a cut paper or a continuous paper, passes is rotatively supported between a right side frame 1*a* and a left side frame (the left side frame is not shown) disposed opposite to each other. The platen 2 functions as a platen means. A rotational drive force is applied onto the platen 2 by a motor GM through a gear G2 fixed in the side frame 1*a*.

A paper bail roller 3, which functions as a paper bail means, is disposed above the platen 2 to move between a position contacting the platen 2 and a position separated from the platen 2 as described below. The paper bail roller 3 has a plurality of rollers 3*b* rotatively supported on a shaft 3*a* that the print medium passes by while being pressed against the platen 2. The ends of the shaft 3*a* are supported by a right side paper bail lever 4*a* and a left side paper bail lever (not shown) pivoted on the right and left side frames, respectively. Each of the paper bail levers is urged toward the platen 2 by an associated spring (the right side spring 43 only is shown) disposed between a pin (the right side pin 41 only is shown) attached to the side frame and a hole (the right side hole 42 only is shown) bored in the paper bail lever.

In front of the platen 2, a guide shaft 7 and a guide rail 8 extend in parallel to the platen 2 with an end of each of the guide shaft 7 and the guide rail 8 supported on the respective side frame. A carriage (not shown) is mounted on the guide shaft 7 and the guide rail 8 for laterally reciprocal movement and a print head (not shown) is fixed on the carriage. A printing operation can be performed on the print medium supported on the platen 2 by the print head while the carriage is reciprocally moved along the guide shaft 7 and the guide rail 8. A sheet guide roller (not shown) is arranged under the platen 2 to press the medium against the platen 2 and to feed the medium therearound. A sheet guide plate 2A is arranged along and substantially parallel to a portion of the circumference of the platen 2.

Figure 5:
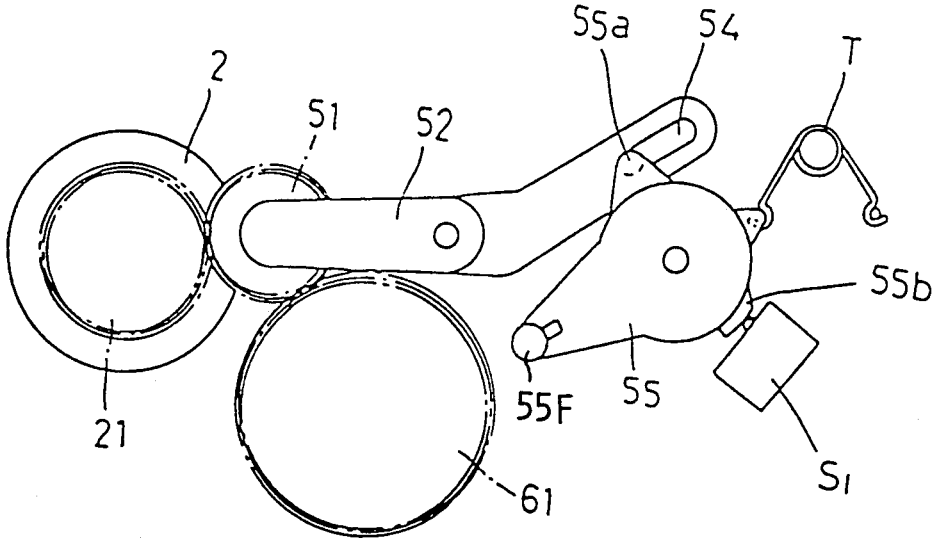
FIG. 5 is schematic view showing a state where a print operation can be performed on the continuous paper.
Figure 6:
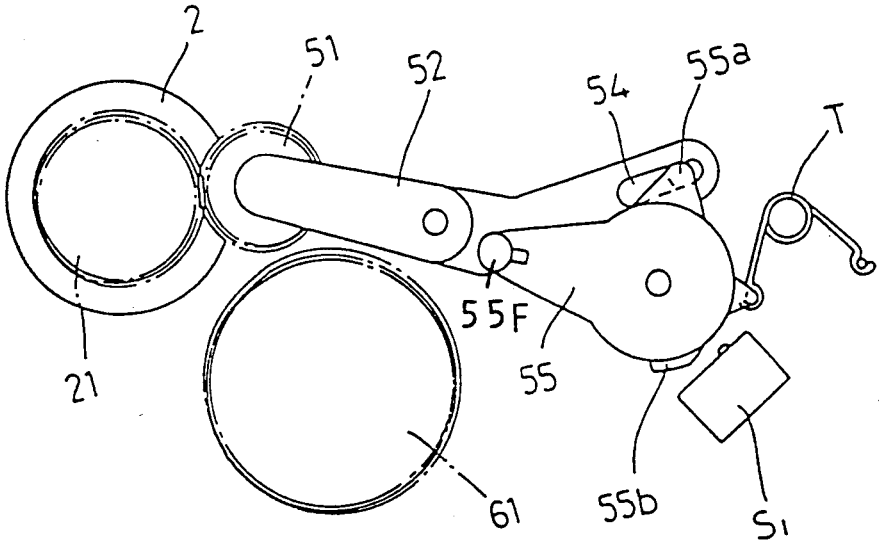
FIG. 6 is schematic view showing a state where a print operation can be performed with respect to the cut paper.

In addition, a tractor driving gear 61 is coupled to a tractor shaft 61*b* which is rotatively supported by both side frames. A gear 61*a* is fixedly attached to the tractor shaft 61*b* inside tractor driving gear 61. A shaft 62 is rotatively supported by the side frames. A gear 62*a* is fixedly attached to shaft 62 and meshes with the gear 61*a*. A pair of tractors, which function as tractor means, (a right side tractor 6 only is shown) are attached to the shaft 62 to move tractor pins 6A, mounted in the tractors 6, in accordance with rotation of the shaft 62. The tractor pins 6A are engaged with holes provided in both sides of a continuous sheet SA. The tractor driving gear 61 rotates the shaft 62 through the tractor shaft 61*b* and the gears 61*a*, 62*a* to transmit the rotational force to the pair of tractors. This is done by transmitting the rotational force of the platen 2 to the tractors as a result of turning the switch lever 55 to be described later (FIGS. 5 and 6).

When the tractor pins 6A are moved toward the platen 2, the continuous sheet SA is fed toward the platen 2 and is inserted between the platen 2 and the sheet guide plate 2A. Above the tractors, a cut sheet guide plate 2B is arranged for feeding a cut sheet SC so that the cut sheet SC can be fed between the platen 2 and the sheet guide plate 2A. When the cut sheet SC is mounted on the sheet guide plate 2A, and the tractor pins 6A do not move toward the platen 2, only the cut sheet SC is fed between the platen 2 and the sheet guide plate 2A. The sheet guide plate 2A, the sheet guide roller and the tractors function as a first feeding means and the sheet guide plate 2A, the sheet guide roller and the cut sheet guide plate 2B function as a second feeding means.

A platen gear 21 is attached to each end of t he shaft of the platen 2. The platen 2 is rotated through the gears G2 by the motor GN. The rotation is transmitted to the tractor driving gear 61 from platen gear 21, at the end away from motor GN, via a clutch gear 51. The clutch gear 51 is mounted on a first clutch lever 52A so that the clutch gear 51 can be meshed with both the platen gear 21 and the tractor driving gear 61 or the clutch gear 51 can be separated from the tractor driving gear 61. To permit such, the first clutch lever 52A is pivoted on a pivot shaft 53 which covers a projection 53A that projects outwardly from the right side of frame 1*a*. A second clutch lever 52B is coupled with the pivot shaft 53 so that the second clutch lever 52B rotates simultaneously with the pivot shaft 53. Therefore, the first clutch lever 52A, the second clutch lever 52B and the pivot shaft 53 rotate simultaneously around the projection 53A. When the second clutch lever 52B rotates clockwise, the gear 5 moves upwards to separate the gear 61 as shown in FIG. 6. When the second clutch lever 52B rotates counterclockwise, the gear 51 moves downwards to contact the gear 61 as shown in FIG. 5. A long slot 54 is bored in the second clutch lever 52B along a long arm of the second clutch lever 52B.

A switch lever 55 is rotatively supported by a projection 55*c* projecting outwardly from the side frame 1*a*. A pin 55*a* of the switch lever 55 is inserted into the slot 54 of the second clutch lever 52B and the second clutch lever 52B is turned according to the turning of the switch lever 55 to be described. Formed on an undersurface of the switch lever 55 is a projection 55*b* for turning on a limit switch S1 according to the turning of the switch lever 55 (FIG. 5). A projection 55*e* extends from the switch lever 55 toward the paper bail lever 4*a*between the frame l*a* and a cam gear 58 described below.

Figure 2:
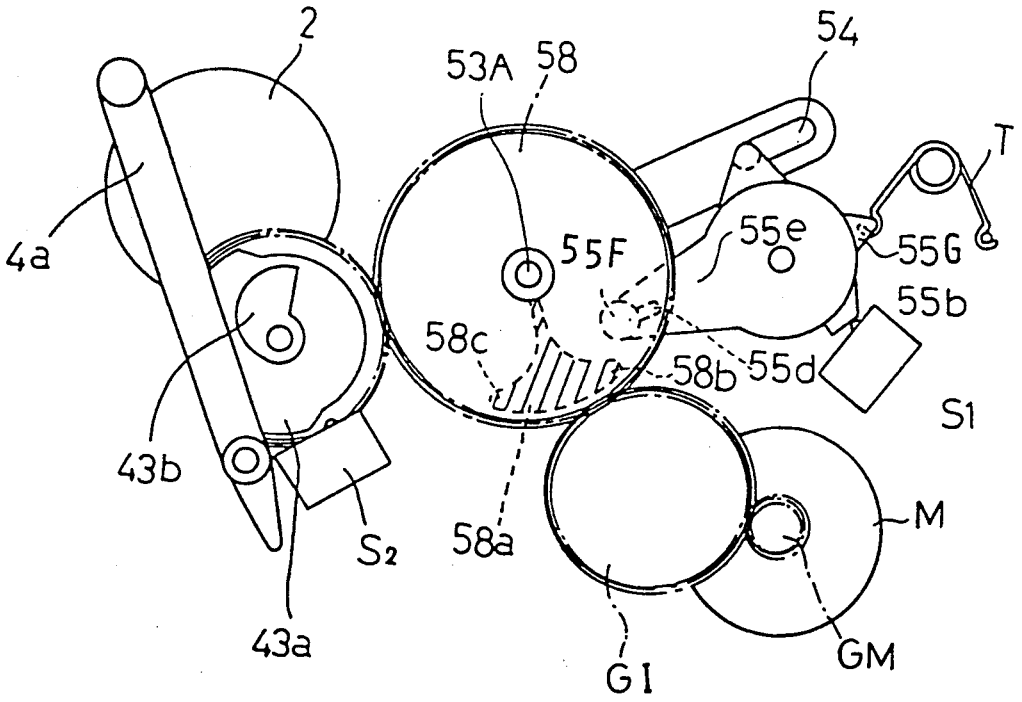
FIG. 2 is schematic view showing the home or base positions of the members of the power train.

A column 55F is formed in a tip of the projection 55*e* so that the column 55F extends in parallel with the projection 53A and toward the cam gear 58. A slope 55*d* having a gradual descent from the column 55F toward a center of the switch lever 55 (the projection 55*e*) is formed on a tip of the column 55F so that the slope 55*d* can be engaged with tips 58*b*, 58*c* of a switch cam 58*a* described below. The column 55F is formed of elastic material, such as resin, so that the tip of the column 55F including the slope 55*d* is bent toward the frame 1*a* when the switch cam 58*a* contacts and presses the column 55F. A portion 55G is arranged on a surface of switch lever 55 directly opposite the projection 55*e* of the switch lever 55 and the portion 55G is engaged with a spring T attached to the frame 1*a* so that the switch lever 55 is biased by the spring T as shown in FIG. 2. The limit switch S1 is mounted on the frame 1*a* so that the switch S1 detects the rotational position of the switch lever 55.

Figure 4:
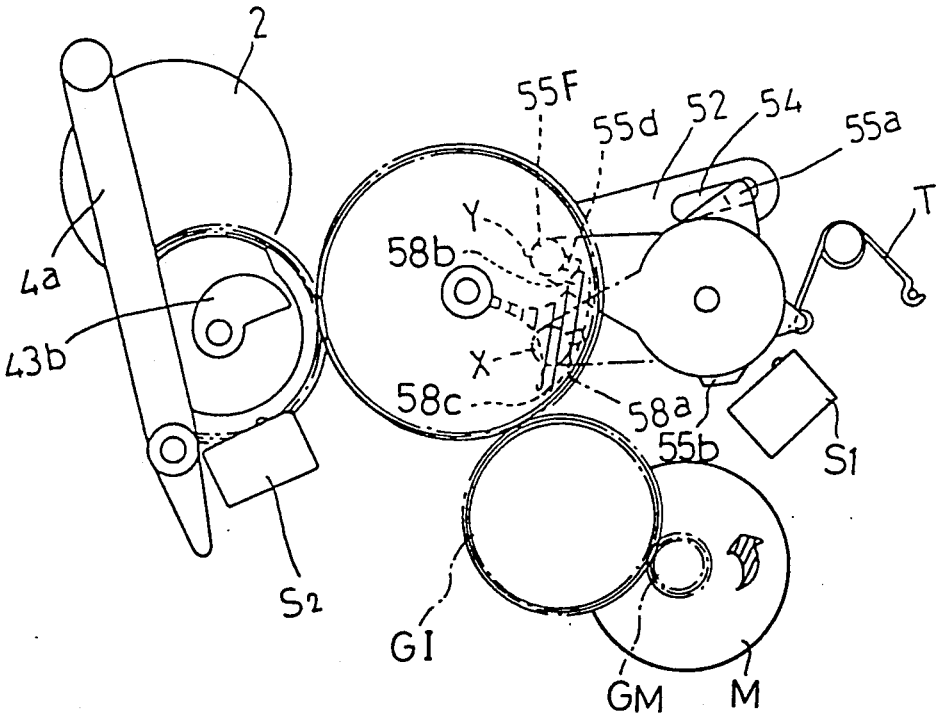
FIG. 4 is schematic view showing the changeover operation from a continuous paper to a cut paper feed.
Figure 7:
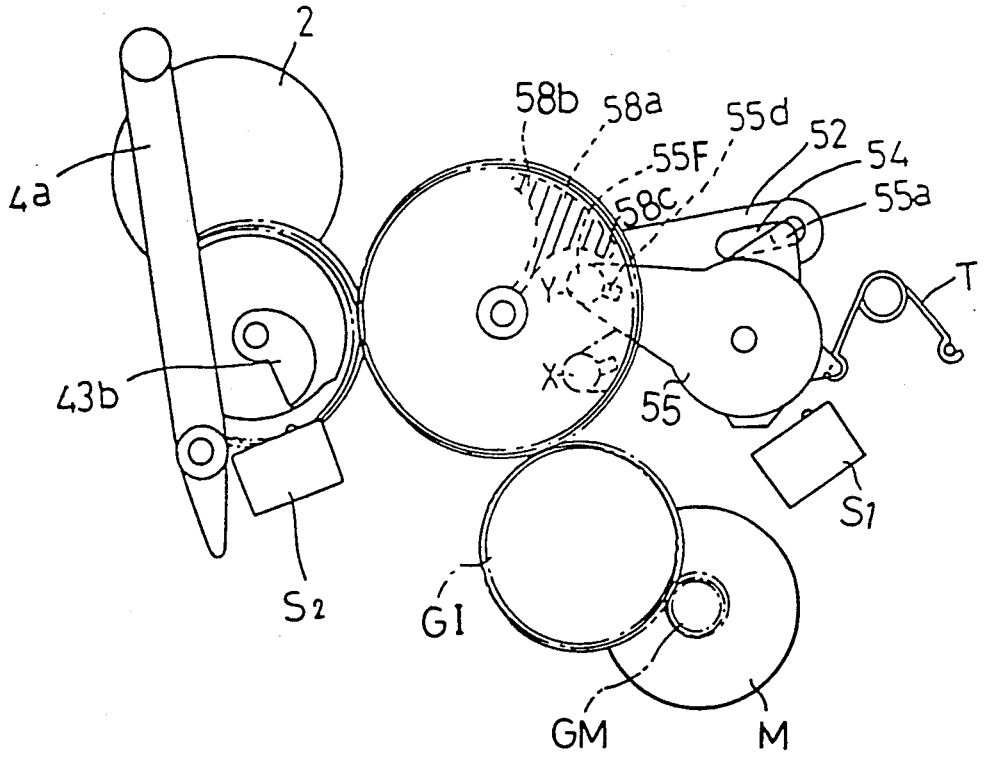
FIG. 7 is schematic view showing the changeover operation from cut paper to a continuous paper feed.

A switch cam gear 58 is rotatively supported on the projection 53A and a cam portion 58*a* is formed on a side of the cam gear 58 faced to the frame 1*a* of the printer. The cam portion 58*a* is, as shown in FIG. 2, formed in a "anchor" shape and a tip 58*b* of the anchor shape of the cam portion 58 is formed in a slope corresponding to the slope 55*d* so that the cam portion 58*a* is engaged with the column 55F as shown in FIG. 4. The other tip 58*c* of the anchor shape of the cam portion 58 is formed in a slope corresponding to the slope 55*d* so that the cam portion 58*a* is engaged with the column 55F as shown in FIG. 7.

A cam gear 43 is meshed with the switch cam gear 58. A first cam portion 43*a* is provided, on the outer side of the cam gear 43, for contacting a limit switch S2 and a second cam portion 43*b* is provided for contacting the paper bail lever 4*a*.

A step motor M, which functions as a second motor means, is disposed on the outside of the right side frame 1*a*. The switch cam gear 58 is rotated according to the rotation of the motor M via a gear GI which is meshed with a motor gear GM of the motor M. The gear GI is rotatively supported on a projection G3 projecting from the frame 1*a*. When the motor M is driven, and the switch cam gear 58 rotates in a counterclockwise direction as shown in FIGS. 4 and 6, the switch lever 55 rotates clockwise, thereby separating the gear 51 from the tractor driving gear 61. When the motor M is driven, and the switch cam gear 58 rotates in a clockwise direction as shown is FIGS. 7 and 5, the switch lever 55 rotates counterclockwise, thereby meshing the gear 51 with the tractor driving gear 61. Consequently, the clutch gear 51 is engaged with or disengaged from the tractor driving gear 61 by the rotation of switch cam gear 58. The switch cam gear 58, the gear GM, the gear GI and the motor M function as a second driving means and the switch cam gear 58 and the motor M function as an actuator means.

The switch cam gear 58 has a first phase corresponding to a position when the paper bail roller 3*b* is separated from the platen 2 and when clutch gear 51 is meshed with both the platen gear 21 and the tractor driving gear 61, a second phase corresponding to a position when the paper bail roller 3*b* contacts the platen 2 and the clutch gear 51 is meshed with both the platen gear 21 and the tractor driving gear 61, and a third phase corresponding to a position when the paper bail roller 3*b* contacts the platen 2 and the clutch gear 51 is disconnected from the tractor driving gear 61. The first, second and third phases correspond to angular positions of the motor M.

In other words, the motor M is adapted to turn the switch cam gear 58 for changing over between continuous paper and cut paper and the cam gear 43 for opening and closing the paper bail roller 3.

The switch cam gear 58 and the cam gear 43 are structured such that the operating portion of the former corresponds to the inoperative portion of the latter, and vice versa, and that the inoperative portion of the former partially corresponds to the inoperative portion of the latter.

A first cam portion 43*a*, formed in the cam gear 43, turns on or off a limit switch S2 and the limit switch S2 is set to detect the point where the cam gear 43 and the switch cam gear 58 are inoperative as an original point.

The gear 51, the clutch levers 52A, 52B and the switch lever 55 function as a clutch means. The cam gear 43 and the second cam portion 43*b* function as a paper bail moving means.

Figure 9:
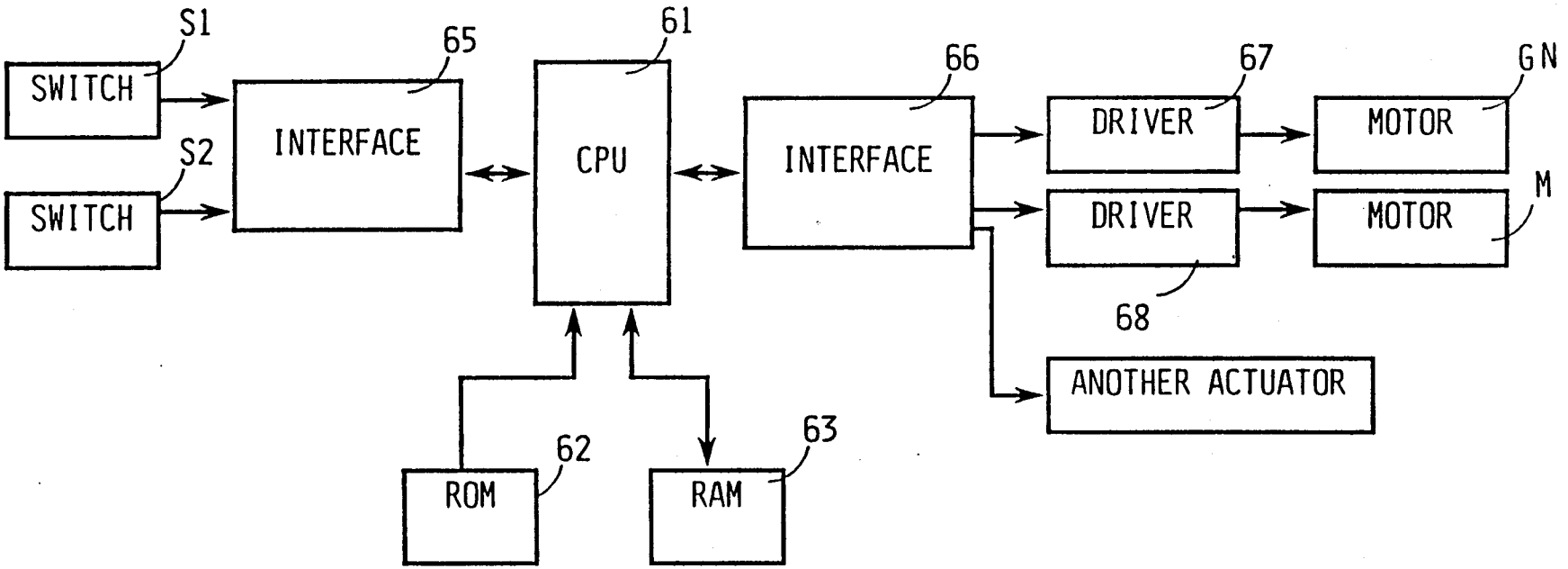
FIG. 9 is a block diagram showing the electrical structure of this embodiment.

The structure of the control circuit will be explained with reference to FIG. 9. A central processing unit (CPU) 61 acts as the control means and is connected to a read only memory (ROM) 62 and a random access memory (RAM) 63. The ROM 62 stores therein a program for controlling the operation of the printer including the number of steps for obtaining a predetermined rotational angle in a direction of the motor M. The number of steps of the step motor from the home position A to a phase B, C, D, E or F position is stored in the ROM 62. The control means is adapted to control not only the step motor M but also the other devices provided in the printer.

In addition, the CPU 61 is connected to the switches S1,S2 via an interface 65 so as to receive signals therefrom. Further, the CPU 61 is connected to the motors GN, M through an interface 66 and drivers 67, 68 so as to output a drive or stop signal to each of the motors 61, 62 respectively.

The operation of the printer will be explained referring to FIGS. 2 through 8.

(A) Power On

At the time of turning on power the CPU 61 confirms the state of the limit switch S2. When the limit switch S2 is in an ON state, the step motor M is rotated counterclockwise. The limit switch S2 is thereby separated from the projection 43*a* to move to an OFF state (FIG. 2). If the limit switch S2 is in the OFF state at the time of turning on the power, the step motor M is rotated clockwise until the limit switch S2 is brought into contact with the first cam portion 43*a* to be turned on, and after that, is phase returned by one step (FIG. 2). This is the home position A.

(B) Release of the paper bail roller

Figure 3:
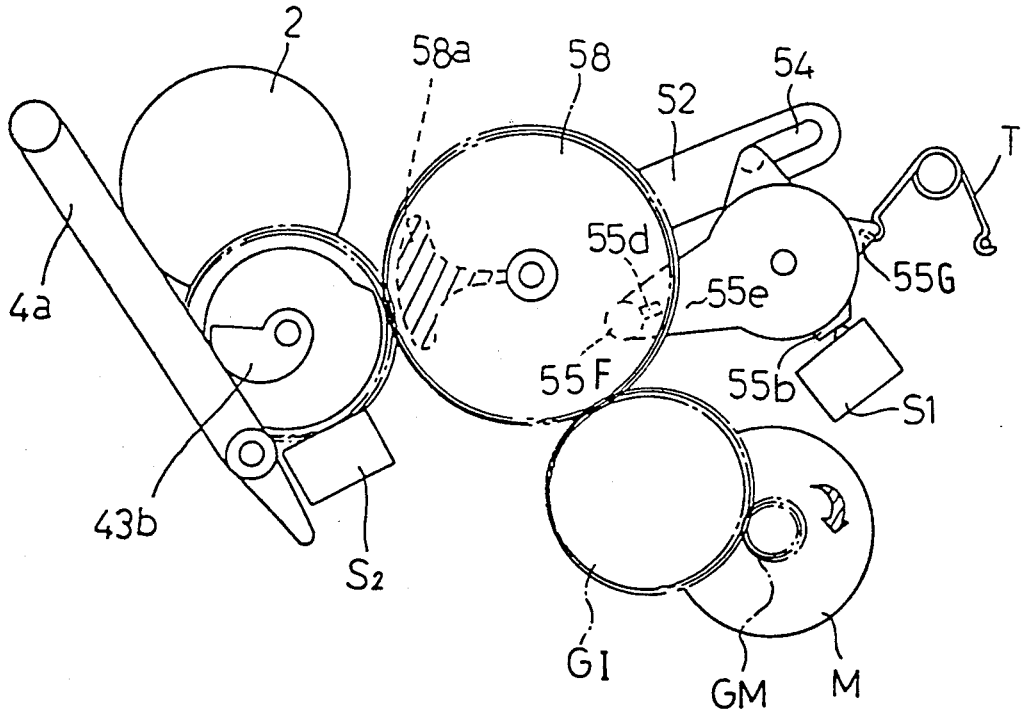
FIG. 3 is schematic view showing the separation of a paper bail roller from a platen.

The step motor M is the rotated clockwise from the home position A to a phase C position while the cam gear 43 is rotated through the gear train GM, GI and 58. The cam 43*b* contacts the paper bail lever 4*a* when step motor M reaches a phase B position, and the paper bail roller 3 begins to be separated from the platen 2. The displacement is a maximum at the phase C position (FIG. 3). After that, the step motor M is rotated counterclockwise so that the paper bail roller 3 is returned to press against the platen 2 by the urging force of a spring 43.

Figure 8:
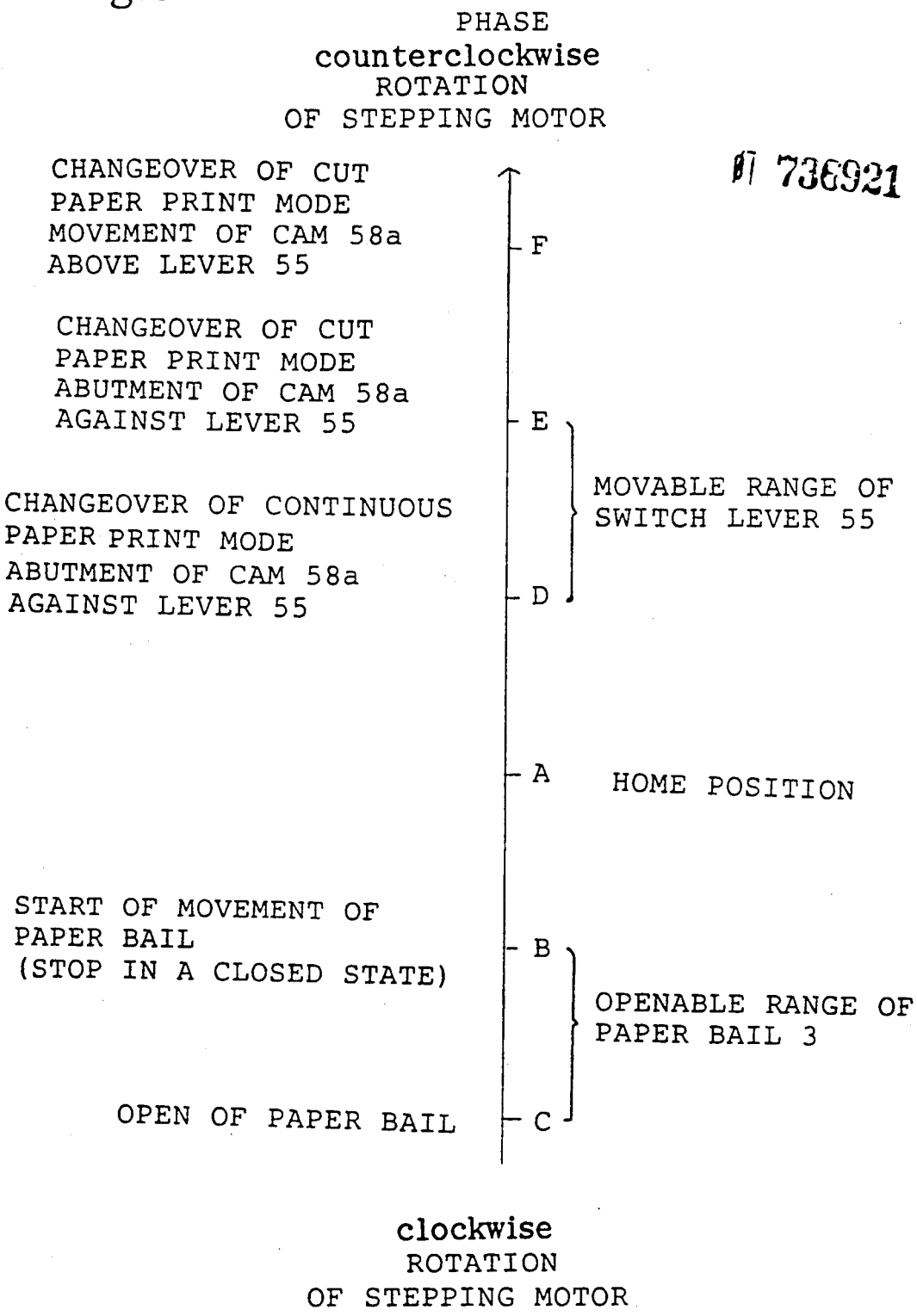
FIG. 8 is schematic diagram showing the relationship of the phases.

As shown in FIG. 8, during the movement from the bail roller 3 is separated from the platen 2, the switch cam 58*a* does not contact the switch lever 55. As a result, paper can be fed independent of the kind of paper being used.

(C) Changeover from continuous paper to cut paper

In a continuous paper print mode, the switch lever 55 is downward in a position X (as depicted by a dashed line in FIG. 4). The step motor M is rotated counterclockwise from the home position A, and the switch cam 58*a* is pressed against the column 55*c* when in a phase D position. In the vicinity of a phase E position, the switch lever 55 is rotated by the spring force beyond the dead point of a torque spring T to be stopped in a position Y (as indicated by a solid line in FIG. 4). The step motor M is halted in the phase E position, and then, is rotated clockwise back to the home position A.

The clutch levers 52A, 52B are pivoted according to the rotation of the switch lever 55 and the clutch gear 51 in mesh with the platen gear 21 and tractor driving gear 61 (FIG. 5) is disengaged from tractor driving gear 61 when step motor M is at the phase E position (FIG. 6) Thus, the rotation of the platen 2 cannot be transmitted to the tractor 6 thereby preventing the continuous paper disposed in the tractor 6 from being fed. In this state, if a cut sheet of paper is inserted between the platen 2 and the feed roller through a cut paper feed port, a print operation can be performed with respect to the cut sheet of paper.

As illustrated in FIG. 8, during the movement of step motor M from the home position A to the phase E position, where the changeover is completed, the cam 43*b* is maintained separated from the paper bail lever 4*a* so that no pressure is exerted to separate the paper bail roller 3 from the platen 2.

(D) Changeover from cut paper to continuous paper

In a cut paper print mode, the switch lever 55 is in a position Y (as depicted by a solid line in FIG. 4). In this position, the step motor M has been rotated counterclockwise from the home position A. As a result, the tip 58*b* of switch cam 58*a* contacts the column 55F of the switch lever 55. With further rotation of step motor M, the switch cam 58*a* contacts and presses the column 55F along a slope 55*d* flexing the switch lever 55 to bend the projection 55*e* toward the frame 1*a* so that switch cam 58 passes over column 55F (FIG. 7). After that, the step motor M is stopped and then rotated clockwise. The column 55F of the switch lever 55 is pressed by the tip 58*c* of switch cam 58*a* so that the switch lever 55 is turned to abut against a stopper (not shown) at the position X and come to a halt. In this state, with the further clockwise rotation of the step motor M, the switch cam 58*a* pushes the column 55F of the switch lever 55 along the slope 55*d* by the flexing of the switch lever 55. After the switch cam 58*a* pushes the column 55F to a point where it passes thereover, the step motor M is brought to a halt at the home position A.

With the rotation of the switch lever 55, the clutch gear 51 disposed at the end of the clutch lever 52A is meshed with the platen gear 21 and tractor driving gear 61 to rotate the two gears 21 and 61 in association with each other (FIG. 5). Therefore, the tractor 6 is rotated at the same speed as the platen 2 rotates. Namely, paper can be fed by the tractor 6 by the same amount as that of paper fed by the platen 2.

As illustrated in FIG. 8, during the movement of the step motor M from the home position A to the phase F position, where the changeover is completed, the cam 43*b*is maintained separated from the paper bail lever 4*a* so that no effect is exerted on the paper bail roller 3.

In the printer described above, the number of I/O ports of the control circuit can be reduced, and accordingly, the printer according to the present invention is effective in the case where a one chip microcomputer is used.

The present invention is not limited to the above embodiment, and it is to be understood that the invention may be embodied with various modifications and improvements.

What is claimed is:

1. A printer comprising:

platen means for supporting a sheet;

a first driving means;

first feeding means for feeding a continuous paper in cooperation with the platen means, said first feeding means being capable of being connected to said first driving means;

second feeding means for feeding a cut sheet of paper in cooperation with said platen means, said second feeding means being connected to said first driving means;

a second driving means;

clutch means for connecting said first driving means and said first feeding means, and for disconnecting said first driving means and said first feeding means based on a driving force exerted by said second driving means;

paper bail means being faced to said platen means, said platen bail means being moved between a position contacting said platen means and a position paper bail moving means for moving said paper bail means between a position contacting said platen means and a position separated from said platen means based on the driving force exerted by said second driving means.

2. The printer as claimed in claim wherein said first feeding means comprises a pair of tractors.

3. The printer as claimed in claim 1, wherein said second driving means comprises an actuator means having first, second and third phases based on rotational angle, the first phase corresponding to a position where said paper bail means is separated from said platen means, the second phase corresponding to a position where said paper bail means contacts said platen means and said clutch means connects said platen means and said first feeding means, and the third phase corresponding to a position where said paper bail means contacts said platen means and said clutch means disconnects said platen means and said first feeding means.

4. The printer as claimed in claim 1, wherein said clutch means comprises:

a first lever pivotally mounted to a side frame of the printer;

a clutch gear mounted at an end of said first lever away from the pivotal mount;

a second lever pivotally mounted to the side frame of the printer to form an extension of said first lever, said second lever having a elongated slot in an angled arm away from the pivotal mount; and a switch means having a pin engaged with said slot, wherein said clutch gear is capable of engaging said first driving means and said first feeding means.

5. The printer as claimed in claim 5, wherein said second driving means comprises:

a step motor;

a drive gear attached to a drive shaft of said step motor;

a intermediate gear meshed with said drive gear; and a cam gear meshed with said intermediate gear.

6. The printer as claimed in claim 4, wherein said cam gear has a cam on an inner surface thereof for engaging a column mounted on an end of an extension of said switch means, said engagement between said column and said cam moving said switch means such that said pin of said switch means moves in said slot of said second clutch lever thereby rotating said first and second clutch levers to separate said clutch gear from said first feed means and said first drive means.

7. A printer comprising:

a platen roller means for supporting and feeding a cut sheet;

a first motor means for rotating said platen roller means;

a second motor means having first, second and third phases base don rotational angle;

tractor means for feeding a continuous paper, said tractor means being capable of connection to said first motor means through said platen roller means;

a clutch means for connection said platen roller means and said tractor means and for disconnecting said platen roller means and said tractor means based on a driving force by said second motor means;

a paper bail roller means faced to said platen means, said platen bail roller means being moved between a position contacting said platen roller means and a position separated from said platen roller means; and paper bail roller moving means for moving said paper bail roller means between a position contacting said platen roller means and a position separated from said platen roller means based on driving force by said second motor means corresponds to a position where said paper bail roller means is separated from said platen roller means, a second phase of said second motor means corresponds to a position where said paper bail roller means contact said platen roller means and said clutch means connects to both said platen roller means and said tractor means, and a third phase of said second motor means corresponds to a position where said second motor roller means contacts said platen roller means and said clutch means disconnects between said platen roller means and said tractor means.

8. The printer as claimed in claim 7, wherein said clutch means comprises:

a first lever pivotally mounted to a side frame of the printer;

a clutch gear mounted at an end of said first lever away from the pivotal mount;

a second lever pivotally mounted to the side frame of the printer to form an extension of said first lever, said second lever having a elongated slot in an angled arm away from the pivotal mount; and a switch means having a pin engaged with said slot, wherein said clutch gear is capable of engaging said first driving means and said first feeding means.

9. The printer as claimed in claim 8, wherein said second driving means comprises:

a step motor;

a drive gear attached to a drive shaft of said step motor;

a intermediate gear meshed with said drive gear; and a cam gear meshed with said intermediate gear.

10. The printer as claimed in claim 9, wherein said cam gear has a cam on an inner surface thereof for engaging a column mounted on an end of an extension of said switch means, said engagement between said column and said cam moving said switch means such that said pin of said switch means moves in said slot of said second clutch lever thereby rotating said first and second clutch levers to separate said clutch gear from said first feed means and said first drive means.

11. The printer as claimed in claim 10, wherein said extension of said switch means is flexible and said column has a slope shaped edge so that contact by said cam forces causes said extension to flex inwardly toward said side frame of the printer allowing said cam and said cam gear to rotate over said column.

* * * * *